US009051628B2

(12) United States Patent
Chen et al.

(10) Patent No.: US 9,051,628 B2
(45) Date of Patent: Jun. 9, 2015

(54) REACTION EQUIPMENT FOR PRODUCING SPONGE TITANIUM

(75) Inventors: Xuemin Chen, Guangdong (CN); Qingdong Ye, Guangdong (CN); Bin Li, Guangdong (CN); Hexi Zeng, Guangdong (CN)

(73) Assignee: SHENZHEN SUNXING LIGHT ALLOYS MATERIALS CO., LTD., Shenzhen, Guangdong (CN)

( * ) Notice: Subject to any disclaimer, the term of this patent is extended or adjusted under 35 U.S.C. 154(b) by 201 days.

(21) Appl. No.: 13/585,770

(22) Filed: Aug. 14, 2012

(65) Prior Publication Data

US 2012/0306129 A1 Dec. 6, 2012

(30) Foreign Application Priority Data

Jan. 18, 2012 (CN) ..... 2012 1 0014898

(51) Int. Cl.

| | |
|---|---|
| ***C22B 34/12*** | (2006.01) |
| ***F27D 27/00*** | (2010.01) |
| ***F27B 19/04*** | (2006.01) |

(52) U.S. Cl.

CPC ..... *C22B 34/1277* (2013.01); *F27D 27/00* (2013.01); *F27B 19/04* (2013.01)

(58) Field of Classification Search

CPC .. C22B 34/1277; C22B 34/1272; F27B 14/04
USPC ..... 266/171, 172; 75/619, 620
See application file for complete search history.

(56) References Cited

U.S. PATENT DOCUMENTS

| | | | | |
|---|---|---|---|---|
| 3,158,671 | A * | 11/1964 | Socci | 266/149 |
| 4,441,925 | A * | 4/1984 | Ishizuka | 75/619 |
| 4,512,557 | A * | 4/1985 | Kimura et al. | 266/171 |
| 7,264,765 | B2 * | 9/2007 | Ono et al. | 266/172 |

* cited by examiner

*Primary Examiner* — Scott Kastler
(74) *Attorney, Agent, or Firm* — Jackson IPG PLLC; Demian K. Jackson

(57) ABSTRACT

The present invention provides a piece of reaction equipment for producing sponge titanium, which includes a reactor and a reactor cover with a stirring device, wherein a sealing ring is arranged between the reactor cover and the reactor, one side of the reactor cover is provided with a lifting device for controlling the lifting of the reactor cover, a resistance furnace is arranged above the reactor cover, a valve is arranged below the resistance furnace, and a vacuum-pumping pipe and an inflation pipe are arranged above the reactor cover. The present invention has the beneficial effects that the production equipment can ensure normal production, and effectively ensures the quality of sponge titanium product; compared with the prior art, the equipment has low cost, environmental protection and harmlessness during production.

10 Claims, 1 Drawing Sheet

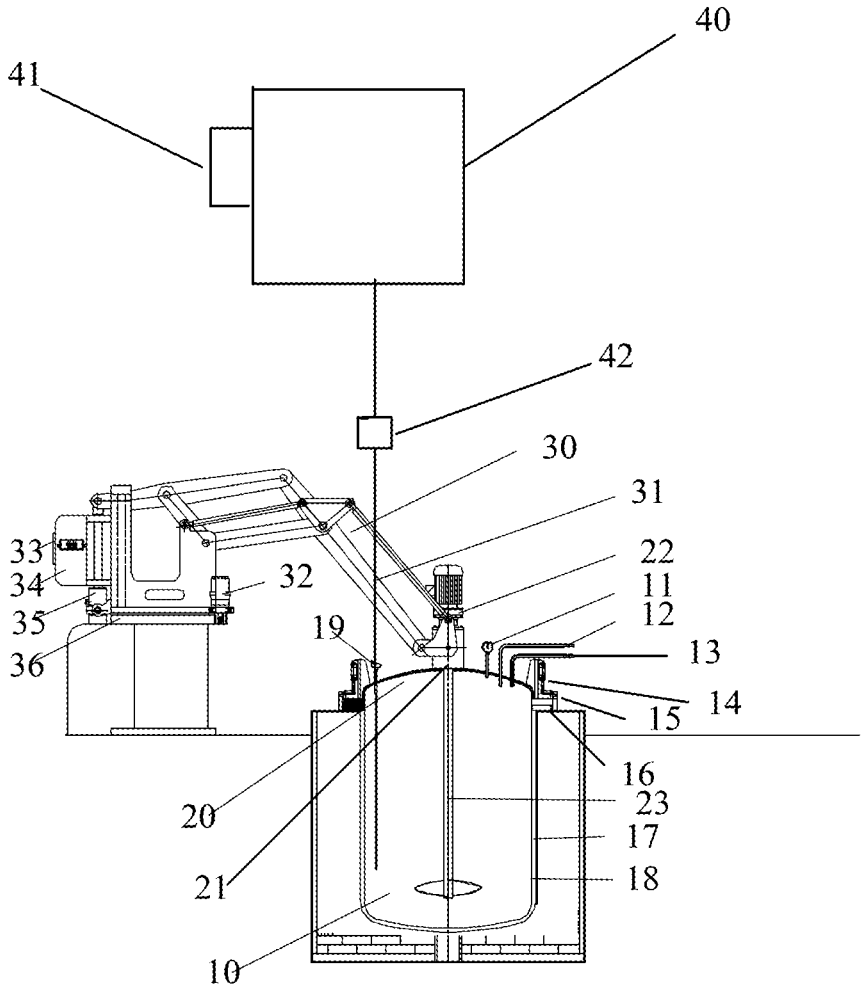
40
41
42
30
31
22
11
12
13
14
15
16
23
17
18
10
21
20
19
32
33
34
35
36

REACTION EQUIPMENT FOR PRODUCING SPONGE TITANIUM

TECHNICAL FIELD OF THE INVENTION

The present invention relates to a piece of reaction equipment for producing sponge titanium, and in particular to a piece of reaction equipment for producing sponge titanium, which is easy to operate, high efficient and can continuously run.

BACKGROUND OF THE INVENTION

The production process of sponge titanium at home and abroad mainly adopts metallothermic reduction process, and in particular refers to preparing metal M from metal reducing agent (R) and metal oxide or chloride (MX). Titanium metallurgy method in which industrial production has been achieved is magnesiothermic reduction process (Kroll process) and sodiothermic reduction process (Hunter process). Since the Hunter process leads to higher production cost than the Kroll process does, the Kroll process is widely used in industry currently. The main processes of the Kroll process are that magnesium ingot is placed into a reactor, heated and molten after being subjected to oxide films and impurities removal, then titanium tetrachloride ($TiCl_4$) is introduced into the reactor, titanium particles generated by the reaction are deposited, and generated liquid magnesium chloride is discharged promptly through a slag hole. The reaction temperature is usually kept at 800° C. to 900° C., the reaction time is between several hours and several days. Residual metallic magnesium and magnesium chloride in end product can be removed by washing with hydrochloric acid, can also be removed by vacuum distillation at 900° C., and keep the purity of titanium high. The Kroll process has the disadvantages of high cost, long production cycle, and polluted environment, limiting further application and popularization. At present, the process has not changed fundamentally, and still belongs to intermittent production, which fails to realize continuous production, and there is no corresponding improved equipment developed, which is not conducive to further development of sponge titanium manufacturing technology.

SUMMARY OF THE INVENTION

In order to solve the shortcomings of high cost, severe pollution and long production cycle in prior art, the present invention provides a method for producing sponge titanium technically:

Scheme 1: a method for preparing titanium from potassium fluotitanate with aluminothermic reduction process:

Equation involved:

$$3K_2TiF_6+4Al=3Ti+6KF+4AlF_3$$

Scheme 2: a method for preparing sponge titanium from potassium fluotitanate with magnesiothermic reduction process:

Equation involved:

$$K_2TiF_6+2Mg=Ti+2MgF_2+2KF$$

Scheme 3: a method for preparing sponge titanium from potassium fluotitanate with aluminum magnesium thermal reduction process:

Equations involved:

$$3K_2TiF_6+4Al=3Ti+6KF+4AlF_3$$

$$K_2TiF_6+2Mg=Ti+2MgF_2+2KF$$

Since the potassium fluotitanate, aluminum and magnesium are solids in the raw material, the present invention designs a piece of reaction equipment for producing sponge titanium, which includes: a reactor and a reactor cover with a stirring device, wherein a sealing ring is arranged between the reactor cover and the reactor, one side of the reactor cover is provided with a lifting device for controlling the lifting of the reactor cover, a resistance furnace is arranged above the reactor cover, a valve is arranged below the resistance furnace, and a vacuum-pumping pipe and an inflation pipe are arranged above the reactor cover.

The present invention, by adopting the above technical schemes, is advantaged in that the metal can be added to the resistance furnace and molten, the molten metal drips into the reactor under the control of a valve to improve the reaction rate. The lifting device is arranged so that it is convenient to feed raw material, the vacuum-pumping pipe is arranged so that the reaction keeps a certain vacuum degree, the inflation pipe is arranged so as to further meet the requirement of not contacting oxygen during reaction to enable the aluminum to be molten completely for reaction, improving the reaction efficiency.

Preferably, the side of the vacuum-pumping pipe is provided with a vacuum pressure gauge for detecting the vacuum degree of the reactor.

The present invention, by further adopting the above technical characteristics, is advantaged in that the vacuum pressure gauge is arranged so that the vacuum degree of the reactor can be ensured at all times during reaction, if the vacuum degree is not enough, the reactor can be vacuumized to improve the reaction efficiency.

Preferably, the reactor cover is also provided with a locking mechanism and a locking cylinder for being fixedly connected with the reactor.

The present invention, by further adopting the above technical characteristics, is advantaged in that the reactor is kept under a condition of totally sealing to further improve the reaction efficiency.

Preferably, the stirring device includes a stirring motor for providing power and a stirring rod arranged below the stirring motor.

Preferably, the lifting device includes a vertical lifting structure connected with the reactor cover, a lifting hydraulic cylinder for providing power and a hydraulic steering motor for adjusting the lifting hydraulic cylinder are arranged below the vertical lifting structure.

Preferably, the inner wall of the reactor is provided with a metal crucible and an electric furnace wire.

Preferably, the reactor is also provided with a thermocouple.

The present invention, by further adopting the above technical characteristics, is advantaged in that the electric furnace wire heats the reactor uniformly to enable balance heating of raw materials in the reactor to further improve the reaction efficiency. Since the crucible can play thermal insulation effect on heat, the heat loss is reduced, to ensure the temperature throughout the metal melting process in the reactor and perform smooth smelting.

Preferably, a touch screen and an electric cabinet for controlling the movement of the lifting device are provided above the lifting hydraulic cylinder.

Preferably, a pivoting support is arranged below the electric cabinet.

The present invention has the beneficial effects that, by adopting the above technical schemes, the production equipment can ensure normal production, and effectively ensures the quality of sponge titanium product. Compared with the prior art, the equipment has low cost, environmental protection and harmlessness during production; the sponge titanium produced by the equipment has high reduction rate and yield, which fundamentally solves the problem of the reaction equipment for producing the sponge titanium with a special process.

BRIEF DESCRIPTION OF THE DRAWINGS

FIG. 1 is a structural diagram of equipment for producing sponge titanium in the present invention.

DETAILED DESCRIPTION OF THE PREFERRED EMBODIMENTS

The preferred embodiments of the present invention are further described in detail below:

FIG. 1 is equipment for producing sponge titanium, which includes a reactor 10 and a reactor cover 20 with a stirring device 21, wherein a sealing ring 16 is arranged between the reactor cover 20 and the reactor 10, one side of the reactor cover 20 is provided with a lifting device 30 for controlling the lifting of the reactor cover 20, a sealed resistance furnace 40 is arranged above the reactor cover 20, a valve 42 is arranged below the resistance furnace 40, and a vacuum-pumping pipe 12 and an inflation pipe 13 are arranged above the reactor cover 20.

The side of the vacuum-pumping pipe 12 is provided with a vacuum pressure gauge 11 for detecting the vacuum degree of the reactor 10.

The reactor cover 20 is also provided with a locking mechanism 15 and a locking cylinder 14 for being fixedly connected with the reactor 10.

The stirring device 21 includes a stirring motor 22 for providing power and a stirring rod 23 arranged below the stirring motor 22.

The lifting device 30 includes a vertical lifting structure 31 connected with the reactor cover 20, a lifting hydraulic cylinder 35 for providing power and a hydraulic steering motor 32 for adjusting the lifting hydraulic cylinder 35 are arranged below the vertical lifting structure 31.

The inner wall of the reactor 10 is provided with a metal crucible 17 and an electric furnace wire 18.

The reactor 10 is also provided with a thermocouple 19.

A touch screen 33 and an electric cabinet 34 for controlling the movement of the lifting device 30 are provided above the lifting hydraulic cylinder 35.

A pivoting support 36 is arranged below the electric cabinet 34.

A resistance furnace 40 is provided with a resistance wire 41.

The process is as follows after the reaction equipment of the present invention is used for process production:

Scheme 1: a method for preparing titanium from potassium fluotitanate with aluminothermic reduction process:

Equation involved:

$$3K_2TiF_6+4Al=3Ti+6KF+4AlF_3$$

Embodiment 1

The method includes the following steps:

Step A: placing 36 g of aluminum into the resistance furnace, vacuum pumping, introducing argon, heating to molten aluminum;

Step B: opening the reactor cover, adding 240 g of potassium fluotitanate to the reactor, leakage detecting after closing the reactor cover, slowly raising the temperature to 150° C., vacuum pumping, and then heating to 250° C.;

Step C: introducing argon into the reactor, continuously raising the temperature to 750° C., stirring uniformly;

Step D: opening a valve to adjust the speed, adding molten aluminum drops, and controlling the reaction temperature to 750° C. to 850° C.;

Step E: opening the reactor cover, removing the stirring device, eliminating the upper layer of $KAlF_4$ to obtain 50.22 g of sponge titanium in which the content of titanium is 90.8% and the reduction rate is 95%.

Embodiment 2

The method includes the following steps:

Step A: placing 40 g of aluminum into the resistance furnace, vacuum pumping, introducing argon, heating to molten aluminum;

Step B: opening the reactor cover, adding 240 g of potassium fluotitanate to the reactor, leakage detecting after closing the reactor cover, slowly raising the temperature to 150° C., vacuum pumping, and then heating to 250° C.;

Step C: introducing argon into the reactor, continuously raising the temperature to 750° C., stirring uniformly;

Step D: opening a valve to adjust the speed, adding molten aluminum drops, and controlling the reaction temperature to 750° C. to 850° C.;

Step E: opening the reactor cover, removing the stirring device, eliminating the upper layer of $KAlF_4$ to obtain 48.39 g of sponge titanium in which the content of titanium is 97% and the reduction rate is 97.8%.

Embodiment 3

The method includes the following steps:

Step A: placing 44 g of aluminum into the resistance furnace, vacuum pumping, introducing argon, heating to molten aluminum;

Step B: opening the reactor cover, adding 240 g of potassium fluotitanate to the reactor, leakage detecting after closing the reactor cover, slowly raising the temperature to 150° C., vacuum pumping, and then heating to 250° C.;

Step C: introducing argon into the reactor, continuously raising the temperature to 750° C., stirring uniformly;

Step D: opening a valve to adjust the speed, adding molten aluminum drops, and controlling the reaction temperature to 750° C. to 850° C.;

Step E: opening the reactor cover, removing the stirring device, eliminating the upper layer of $KAlF_4$ to obtain 48.29 g of sponge titanium in which the content of titanium is 98.6% and the reduction rate is 99.2%.

TABLE 1

Reaction test data

| Embodiment | Amount of added raw material, g | | Theoretical Ti quantity, | Obtained sponge titanium product, | Ti content of product, | Reduction rate, |
|---|---|---|---|---|---|---|
| | $K_2TiF_6$ | Al | g | g | % | % |
| 1 | 240 | 36 | 48 | 50.22 | 90.8 | 95 |
| 2 | 240 | 40 | 48 | 48.39 | 97 | 97.8 |
| 3 | 240 | 44 | 48 | 48.29 | 98.6 | 99.2 |

Reduction rate(%)=(obtained sponge titanium product*Ti content of product)/theoretical Ti quantity Scheme 2: a method for preparing sponge titanium from potassium fluotitanate with magnesiothermic reduction process Equation involved:

$$K_2TiF_6+2Mg=Ti+2MgF_2+2KF$$

Embodiment 4

The method includes the following steps:

Step A: placing 48 g of aluminum into the resistance furnace, vacuum pumping, introducing argon, heating to molten aluminum;

Step B: opening the reactor cover, adding 240 g of potassium fluotitanate to the reactor, leakage detecting after closing the reactor cover, slowly raising the temperature to 150° C., vacuum pumping, and then heating to 250° C.;

Step C: introducing argon into the reactor, continuously raising the temperature to 750° C.;

Step D: opening a valve to adjust the speed, adding molten aluminum drops, and controlling the reaction temperature to 750° C. to 850° C.;

Step E: opening the reactor cover, removing the stirring device, eliminating the upper layers of KF and $MgF_2$ to obtain 47.56 g of sponge titanium in which the content of titanium is 99.2% and the reduction rate is 98.3%.

TABLE 2

Reaction test data

| Embodiment | Amount of added raw material, g | | Theoretical Ti quantity, | Obtained sponge titanium product, | Ti content of product, | Reduction rate, |
|---|---|---|---|---|---|---|
| | $K_2TiF_6$ | Mg | g | g | % | % |
| 4 | 240 | 48 | 48 | 47.56 | 99.2 | 98.3 |

Scheme 3: a method for preparing sponge titanium from potassium fluotitanate with aluminum magnesium thermal reduction process Equations involved:

$$3K_2TiF_6+4Al=3Ti+6KF+4AlF_3$$

$$K_2TiF_6+2Mg=Ti+2MgF_2+2KF$$

Embodiment 5

The method includes the following steps:

Step A: placing 36 g of aluminum and 36 g of magnesium into the resistance furnace, vacuum pumping, introducing argon, heating to generate a mixed liquid;

Step B: opening the reactor cover, adding 240 g of potassium fluotitanate to the reactor, leakage detecting after closing the reactor cover, slowly raising the temperature to 150° C., vacuum pumping, and then heating to 250° C.;

Step C: introducing argon into the reactor, continuously raising the temperature to 750° C.;

Step D: opening a valve to adjust the speed, adding mixed liquid drops, and controlling the reaction temperature to 750° C. to 850° C.;

Step E: opening the reactor cover, removing the stirring device, eliminating the upper layers of $KAlF_4$, KF and $MgF_2$ to obtain 45.12 g of sponge titanium in which the content of titanium is 96.5% and the reduction rate is 90.7%.

Embodiment 6

The method includes the following steps:

Step A: placing 36 g of aluminum and 18 g of magnesium into the resistance furnace, vacuum pumping, introducing argon, heating to generate a mixed liquid;

Step B: opening the reactor cover, adding 240 g of potassium fluotitanate to the reactor, leakage detecting after closing the reactor cover, slowly raising the temperature to 150° C., vacuum pumping, and then heating to 250° C.;

Step C: introducing argon into the reactor, continuously raising the temperature to 750° C.;

Step D: opening a valve to adjust the speed, adding mixed liquid drops, and controlling the reaction temperature to 750° C. to 850° C.;

Step E: opening the reactor cover, removing the stirring device, eliminating the upper layers of $KAlF_4$, KF and $MgF_2$ to obtain 45.45 g of sponge titanium in which the content of titanium is 98% and the reduction rate is 92.8%.

Embodiment 7

The method includes the following steps:

Step A: placing 36 g of aluminum and 9 g of magnesium into the resistance furnace, vacuum pumping, introducing argon, heating to generate a mixed liquid;

Step B: opening the reactor cover, adding 240 g of potassium fluotitanate to the reactor, leakage detecting after closing the reactor cover, slowly raising the temperature to 150° C., vacuum pumping, and then heating to 250° C.;

Step C: introducing argon into the reactor, continuously raising the temperature to 750° C.;

Step D: opening a valve to adjust the speed, adding mixed liquid drops, and controlling the reaction temperature to 750° C. to 850° C.;

Step E: opening the reactor cover, removing the stirring device, eliminating the upper layers of $KAlF_4$, KF and $MgF_2$ to obtain 47.9 g of sponge titanium in which the content of titanium is 95.5% and the reduction rate is 99.3%.

Embodiment 8

The method includes the following steps:

Step A: placing 36 g of aluminum and 2 g of magnesium into the resistance furnace, vacuum pumping, introducing argon, heating to generate a mixed liquid;

Step B: opening the reactor cover, adding 240 g of potassium fluotitanate to the reactor, leakage detecting after closing the reactor cover, slowly raising the temperature to 150° C., vacuum pumping, and then heating to 250° C.;

Step C: introducing argon into the reactor, continuously raising the temperature to 750° C.;

Step D: opening a valve to adjust the speed, adding mixed liquid drops, and controlling the reaction temperature to 750° C. to 850° C.;

Step E: opening the reactor cover, removing the stirring device, eliminating the upper layers of $KAlF_4$, KF and $MgF_2$ to obtain 48.29 g of sponge titanium in which the content of titanium is 98.9% and the reduction rate is 99.5%.

TABLE 3

| Reaction test data | | | | | | | |
|---|---|---|---|---|---|---|---|
| Embodiment | Amount of added raw material, g | | | Theoretical Ti quantity, | Obtained sponge titanium product, | Ti content of product, | Reduction rate, |
| | $K_2TiF_6$ | Al | Mg | g | g | % | % |
| 5 | 240 | 36 | 36 | 48 | 45.12 | 96.5 | 90.7 |
| 6 | 240 | 36 | 18 | 48 | 45.45 | 98 | 92.8 |
| 7 | 240 | 36 | 9 | 48 | 47.9 | 99.5 | 99.3 |
| 8 | 240 | 36 | 2 | 48 | 48.29 | 98.9 | 99.5 |

The above is the further detailed description made to the invention in conjunction with specific preferred embodiments, but it should not be considered that the specific embodiments of the invention are only limited to the these descriptions. For one of ordinary skill in the art to which the invention belongs, many simple deductions and replacements can be made without departing from the inventive concept. Such deductions and replacements should fall within the scope of protection of the invention.

What is claimed is:

1. Reaction equipment for producing sponge titanium, comprising a reactor and a reactor cover with a stirring device, wherein a sealing ring is arranged between the reactor cover and the reactor, one side of the reactor cover is provided with a lifting device for controlling the lifting of the reactor cover, a resistance furnace is arranged above the reactor cover, a valve is arranged below the resistance furnace, and a vacuum-pumping pipe and an inflation pipe are arranged above the reactor cover, wherein the valve is connected to the furnace and serves as a connection between the furnace and the reactor through the reactor cover.

2. The reaction equipment for producing sponge titanium according to claim 1, wherein the side of the vacuum-pumping pipe is provided with a vacuum pressure gauge for detecting the vacuum degree of the reactor.

3. The reaction equipment for producing sponge titanium according to claim 1, wherein the reactor cover is also provided with a locking mechanism and a locking cylinder for being fixedly connected with the reactor.

4. The reaction equipment for producing sponge titanium according to claim 1, wherein the stirring device comprises a stirring motor for providing power and a stirring rod arranged below the stirring motor.

5. The reaction equipment for producing sponge titanium according to claim 1, wherein the lifting device comprises a vertical lifting structure connected with the reactor cover, a lifting hydraulic cylinder for providing power and a hydraulic steering motor for adjusting the lifting hydraulic cylinder are arranged below the vertical lifting structure.

6. The reaction equipment for producing sponge titanium according to claim 1, wherein the inner wall of the reactor is provided with a metal crucible and an electric furnace wire.

7. The reaction equipment for producing sponge titanium according to claim 6, wherein the reactor is also provided with a thermocouple.

8. The reaction equipment for producing sponge titanium according to claim 5, wherein a touch screen and an electric cabinet for controlling the movement of the lifting device are provided above the lifting hydraulic cylinder.

9. The reaction equipment for producing sponge titanium according to claim 8, wherein a pivoting support is arranged below the electric cabinet.

10. The reaction equipment for producing sponge titanium according to claim 1, wherein a resistance furnace is provided with a resistance wire.

* * * * *